US010328484B2

(12) United States Patent
Thiel et al.

(10) Patent No.: US 10,328,484 B2
(45) Date of Patent: Jun. 25, 2019

(54) FOUNDRY SAND

(71) Applicants: Iluka Resources Limited, Perth, Western Australia (AU); University of Northern Iowa Research Foundation, Cedar Falls, IA (US)

(72) Inventors: Gerard Thiel, Cedar Falls, IA (US); Sairam Ravi, Cedar Falls, IA (US)

(73) Assignees: Iluka Resources Limited, Perth, Western Australia (AU); University of Northern Iowa Research Foundation, Cedar Falls, IA (US)

( * ) Notice: Subject to any disclaimer, the term of this patent is extended or adjusted under 35 U.S.C. 154(b) by 0 days.

(21) Appl. No.: 15/093,535

(22) Filed: Apr. 7, 2016

(65) Prior Publication Data

US 2016/0303644 A1 Oct. 20, 2016

Related U.S. Application Data

(60) Provisional application No. 62/149,761, filed on Apr. 20, 2015.

(51) Int. Cl.
*B22C 1/02* (2006.01)
*B22C 9/02* (2006.01)

(52) U.S. Cl.
CPC . *B22C 9/02* (2013.01); *B22C 1/02* (2013.01)

(58) Field of Classification Search
CPC ..... B22C 1/02; B22C 9/02
See application file for complete search history.

(56) References Cited

U.S. PATENT DOCUMENTS 2,752,259 A * 6/1956 Cook ..... C04B 35/48 501/107
3,278,316 A * 10/1966 Sawyer, Jr. ..... B22C 1/26 106/219
4,115,345 A * 9/1978 Bushey ..... B22C 1/188 106/450
4,735,973 A * 4/1988 Brander ..... B22C 1/02 106/439
5,094,289 A * 3/1992 Gentry ..... B22C 1/00 106/38.22
5,695,554 A * 12/1997 Landis ..... B22C 1/00 106/38.2
5,769,933 A * 6/1998 Landis ..... B22C 1/00 106/38.2
8,623,959 B2 * 1/2014 Fuqua ..... B22C 1/02 524/871
8,778,076 B2 * 7/2014 Haanepen ..... B22C 3/00 106/38.2
9,038,708 B1 * 5/2015 Hoffman, Jr. ..... B22C 1/02 164/526
2010/0269998 A1 * 10/2010 Landis ..... B22C 1/181 164/37

OTHER PUBLICATIONS

"Unbonded and Reclaimed Sands", AFS Mold & Core Test Handbook, 2nd Edition, 1 pg. (known admitted prior art).
Giese, S.R. et al., "Numeric Ranking of Step Cone Test Castings", AFS Transactions, 115: 1-10 (2007).
Naro, Rl. et al., "Variables Affecting the Formation of Porosity Defects in Iron Castings Prepared with Urethane Binder Systems", AFS Transactions, 82: 257-266 (1974).
Ravi, S. et al., "The Use of Specialty Sand Blends to Improve Casting Quality and Reduce Costs", 71st World Foundry Congress, Advanced Sustainable Foundry, 12 pages (2014).
Tardos, G. et al., "Measurement of Surface Viscosities Using a Dilatometer", The Canadian Journal of Chemical Engineering, 62: 884-888 (1984).
Tordoff, W.L. et al., "Test Casting Evaluation of Chemical Binder Systems", AFS Transactions, 88: 149-158 (1980).
Thiel, J. et al., "Investigation into the Technical Limitations of Silica Sand Due to Thermal Expansion", AFS Transactions, 115: 1-18 (2007).
Thiel, J. et al., "High Temperature Physical Properties of Chemically Bonded Sands and what to do with them", SFSA Technical and Operating Conference Proceedings, 16 pgs (2009).
Thiel, J. et al., "High Temperature Physical Properties of Chemically Bonded Sands Provide Insight into Core Distortion and Provides New Data for Casting Process Simulation", AFS Transactions, 117: 323-339 (2009).

* cited by examiner

*Primary Examiner* — Anthony J Green
(74) *Attorney, Agent, or Firm* — Merchant & Gould P.C.

(57) ABSTRACT

A foundry sand comprises a blend that includes a silica sand and a zircon aggregate. The zircon aggregate exhibiting a sharp rise in linear thermal expansion coefficient in a temperature band above 1200° C. A method of casting an article in molten metal at a temperature above 1200° C. includes forming a single or multi-part mold for the article from the above-described foundry sand, admitting molten metal to the mold at a temperature such that at least one or more regions of the foundry sand in contact with the admitted metal are heated to a temperature within the temperature band, and cooling the mold and metal to obtain a cast article.

23 Claims, 6 Drawing Sheets

FOUNDRY SAND

This application claims the benefit of priority to U.S. Provisional Patent Application No. 62/149,761 filed Apr. 20, 2015, the disclosure of which is herein incorporated by reference in its entirety. To the extent appropriate, a claim of priority is made to the above disclosed application.

FIELD OF THE INVENTION

The invention relates generally to foundry sands and in particular to an improved silica blend foundry sand and to a casting method that employs the improved foundry sand.

BACKGROUND OF THE INVENTION

Silica sand is the most widely used aggregate in the foundry industry. Its low cost, due to its abundance, makes it an attractive option to metal casters. However, steel and iron castings in silica sand molds tend to exhibit defects such as veining, fins and dimensional inaccuracy. This is, in part, due to the large thermal expansion of silica sand. Previous studies into the high temperature properties of silica sand have addressed the technical limitations metal casters face while using silica sand molds or cores. Silica sand undergoes various phase transitions while being heated up to high temperatures. Once past the alpha-beta phase transition at approximately 570° C. (1058 F), silica sand experiences a steady contraction till the cristobalite phase transition at 1470° C. (2678 F). Various sand additives such as iron oxide or Engineered Sand Additives (ESA) are used in the metal casting industry to either induce a tridymite transition, which leads to a secondary expansion, or induce the cristobalite transition at a lower temperature, which causes a large secondary expansion. These additives cause large changes in the volume of bonded sand.

Veining defects in silica sand are caused by the loss of strength on the surface of the cores, which leads to a network of cracks arising from the high thermal expansion of the sand. These cracks are then filled by the liquid metal, which breakouts thereby form veins on the surface of the casting. Certain additives promote the sintering of the surface of the core and form a partially melted surface. This causes an increase in the rigidity of the surface due to the increase in the viscosity of the sintered surface. The increase in viscosity at higher temperatures leads to higher strengths on the surface of the core, resulting in reduced core distortion. The alpha-beta transition in silica sand is associated with a high peak expansion which causes dimensional inaccuracy in steel castings. The dimensional accuracy of castings depends on various factors such as section thickness of the casting, temperature and expansion and does not exhibit a linear trend as per the patternmaker's shrink rule.

Due to the above mentioned limitations of silica sand, certain specialty aggregates such as zircon or chromite are used as core materials for steel castings. Both these aggregates have low thermal expansion when compared to silica sand. They also have higher refractory values. These properties result in a lower core distortion, thereby leading to more dimensionally accurate castings. A major limitation, however, on the use of specialty aggregates is their relatively higher cost, and their use is thus usually confined to certain casting applications that unavoidably require the use of 100% specialty sands. For most other applications, a small improvement in the high temperature properties of silica sand will result in good casting quality and dimensional accuracy.

It is an object of the present invention to address the difficulties encountered with silica sands as a foundry sand in a manner that achieves improved castings at an acceptable cost.

As used herein, except where the context requires otherwise, the term "comprise" and variations of the term, such as "comprising", "comprises" and "comprised", are not intended to exclude further additives, components, integers or steps.

SUMMARY OF THE INVENTION

The present invention starts from a realisation that certain zircon aggregates, unlike other zircon aggregates, exhibit a sharp rise in linear thermal expansion coefficient in a temperature band above 1200° C., and that a foundry sand blend of silica sand and a proportion of such zircon aggregates gives rise to metal castings of improved quality compared to those cast in silica sand alone.

The invention accordingly provides, in a first aspect, a foundry sand comprising a blend that includes a silica sand and a zircon aggregate, the zircon aggregate exhibiting a sharp rise in linear thermal expansion coefficient in a temperature band above 1200° C.

In a second aspect, the invention provides a method of casting an article in molten metal at a temperature above 1200° C., comprising:

- forming a single or multi-part mould for the article from a foundry sand comprising a blend that includes a silica sand and a zircon aggregate, the zircon aggregate exhibiting a sharp rise in linear thermal expansion coefficient in a temperature band above 1200° C.;
- admitting molten metal to the mould at a temperature such that at least one or more regions of the foundry sand in contact with the admitted metal are heated to a temperature within said temperature band; and
- cooling the mould and metal to obtain a cast article.

In a third aspect, the invention provides a method of casting an article in molten metal at a temperature above 1200° C., comprising:

- sourcing and/or supplying a zircon aggregate that exhibits a sharp rise in linear thermal expansion coefficient in a temperature band above 1200° C.;
- forming a single or multi-part mould for the article from a foundry sand comprising a blend that includes a silica sand and said zircon aggregate;
- admitting molten metal to the mould at a temperature such that at least one or more regions of the foundry sand in contact with the admitted metal are heated to a temperature within said temperature band; and
- cooling the mould and metal to obtain a cast article.

Advantageously, the aforesaid temperature band includes commencement of the sharp rise in the linear thermal expansion coefficient of the zircon aggregate at a temperature between 1300° C. and 1500° C., for example between 1325° C. and 1450° C.

Preferably, the zircon aggregate exhibits an increase in linear thermal expansion from substantially zero to at least about 0.010 in/in, more preferably to between 0.020 and 0.030 in/in.

Preferably, the zircon aggregate is such that the foundry sand blend exhibits a reduced magnitude of the linear thermal expansion coefficient at the alpha-beta silica phase transition, and/or the cristobalite silica phase transition commences at a lower temperature, in both cases compared to silica foundry sand.

The reduction in the magnitude of the linear thermal expansion coefficient at the alpha-beta silica phase transition is preferably at least 30%.

The temperature at which the cristobalite silica phase transition commences is preferably reduced from about 1470° C. to below 1300° C., more preferably to below 1270° C.

Although the foundry sand blend exhibits a marked contraction, from the alpha-beta phase transition to the cristobalite phase transition, since the cristobalite phase transition is occurring at a substantially lower temperature, e.g. at approximately 1200 C, the large secondary expansion occurs at a lower temperature, thereby negating the strain on the surface of the core at the high temperatures seen in e.g. steel castings. This provides a secondary increase in strength on the surface of the core, preventing cracks from forming on the surface and hence, reducing veining defects in the cast article.

Preferably, the proportion of the zircon aggregate in the blend is in the range 5 to 40%, more preferably 5 to 25%, most preferably 5 to 15%.

The optimum proportion of zircon aggregate is dependent on a balance between the increasing cost of a higher proportion and the degree of increased benefit. For example, increasing zircon aggregate steadily lowers the temperature at which the cristobalite phase transition commences, but the increased cost may produce only marginal benefit. In fact, it is found that veining and penetration tendencies are both slightly higher at 20% or 30% zircon aggregate than 10% zircon aggregate, primarily in to thicker casting sections: this suggests that the optimum proportion of zircon aggregate may vary according to the shape and/or dimensions of the article to be cast.

It is thought that the observed sharp rise in linear thermal expansion coefficient of the selected zircon aggregate in a temperature band above 1200° C. may be related to an observed relatively higher proportion of a combination of $Fe_2O_3$, $TiO_2$ and $Al_2O_3$ content, for example 2.0-4.0% w/w.

A suitable zircon aggregate for the blend and method of the invention is a differentiated zircon aggregate from Iluka Resources Limited, Zircon grade F or P, or an aggregate of the composition range set out below in Table 2.

The present invention is applicable to the casting of a wide range and variety of metals including iron, steel, other iron alloys and aluminium. The term "casting" is employed herein in a broad sense and embraces, for example, the application of foundry sand to 3-dimensional printing.

The invention further provides an article cast in a mould formed from a foundry sand according to the first aspect of the invention, or cast by a method according to the second or third aspect.

DETAILED DESCRIPTION

Example 1

A range of specialty aggregates listed in Table 1 was evaluated for linear thermal expansion coefficient.

TABLE 1

| Speciality Aggregates evaluated | |
|---|---|
| 1 | Florida Zircon |
| 2 | South Africa Zircon |
| 3 | Iluka grade F Zircon |
| 4 | C80 Zircon |
| 5 | Iluka grade P Zircon |
| 6 | Carbo Accucast ID50-K |
| 7 | Spherichrome |
| 8 | Hevi Sand |

A commercial Furan binder system was used for sand core preparation for all tests.

A Batch of silica sand (3000 grams) was placed in a Kitchen Aid mixer. The co-reactant was first added to the sand and mixed for 60 seconds, after which the resin was added and mixed for a further 60 seconds. The sand was then packed into respective core boxes and allowed to cure while checking for work time and strip time. After strip time was reached, the cores were placed on a shelf and allowed to cure for 24 hours before testing. A resin content of 1% based on sand and co-reactant content of 30% based on resin was used for all cores.

The University of Northern Iowa Dilatometer (see example 2 for details) was used to run the linear expansion tests. Tests were run from room temperature to 1600° C. at a rate of 15° C. per minute. Surface Viscosity results were obtained from linear expansion using a constant load of 23.2 grams on the sample. It is a measure of the movement of individual sand grains on the surface of the sample and is a good indicator of high temperature phase transitions, especially in silica sand.

Figure 1:
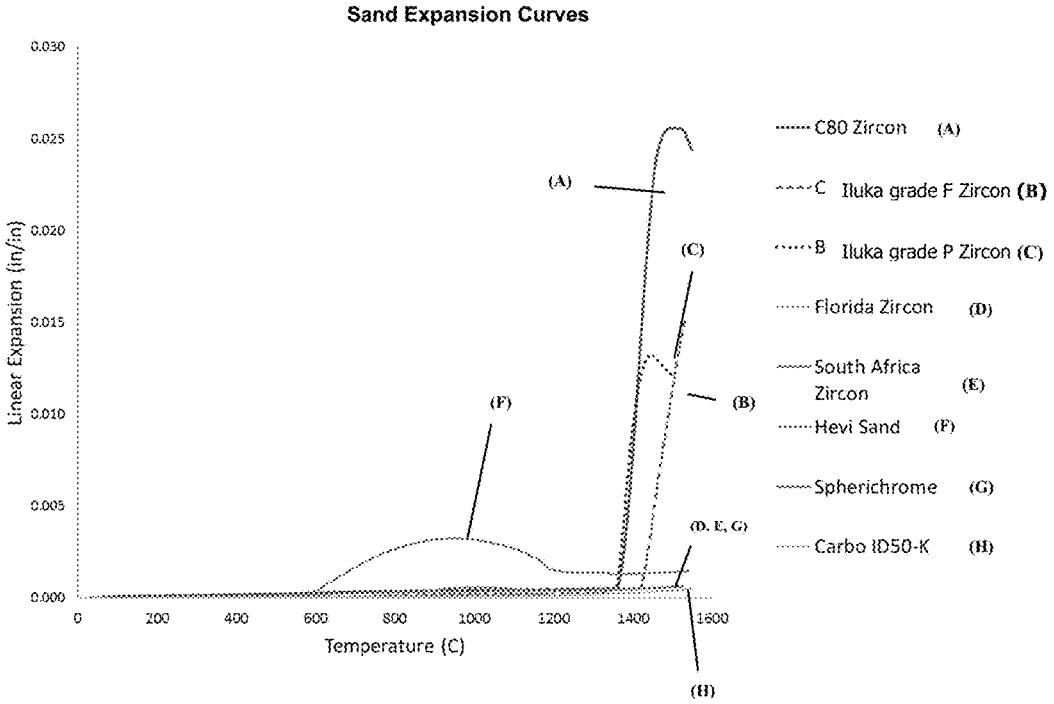
FIG. 1 is a graph of linear sand expansion curves.

The thermal linear expansion curves obtained are shown in FIG. 1. With the exception of Iluka grade F, C80 and Iluka grade P Zircon, the linear expansion results of other aggregates were as expected. Low thermal linear expansion values were obtained for these aggregates. Iluka grade F Zircon shows a sudden increase in expansion at 1400° C. while C80 and Iluka grade P zircon displays the same behavior at ~1340° C. The expansions seen for these three aggregates were unusual and, to verify the repeatability, these three samples were tested again. A good repeatability was obtained.

Surface viscosity was measured from the linear expansion results. As mentioned earlier, it is a measure of the movement of individual sand grains on the surface of the sample and is a good indicator of high temperature phase transitions and sinter points.

It was found that all aggregates displayed an initial increase in viscosity at around 100-150° C. This phenomenon is due to the resin in the aggregate leading to an initial increase in the strength of the bonded aggregate up to a certain point. With the exception of Carbo ID50-K, the viscosity then decreased in the other aggregates with temperature leveling off at around 600-650° C., by when the binder is burnt off. After this point, the viscosity is steady up to the high temperature range when sand sinters and the viscosity subsequently decreases.

Iluka grade F, C80 and Iluka grade P Zircon exhibited a sudden drop in viscosity at ~1400° C. Carbo ID50-K also had a rapid decrease in viscosity from 1100° C. to 1550° C. The surface viscosity of known aggregates typically decreases slowly with temperature.

Table 2 provides an analysis of the C80 zircon aggregate. The aggregate is a post-treated, highly separated and differentiated product from Iluka Resources Limited. A feature of this zircon aggregate is its relatively higher proportion of a combination of $Fe_2O_3$, $TiO_2$ and $Al_2O_3$. Most zircon aggregates contain no more than 2.0% w/w combination of $Fe_2O_3$, $TiO_2$ and $Al_2O_3$.

TABLE 2

Analysis of C80 Zircon aggregate

| Chemical Component | Composition (w/w %) |
|---|---|
| $ZrO_2$ and $HfO_2$ | 64.0-66.7 |
| $Fe_2O_3$, $TiO_2$ and $Al_2O_3$ | 1.0-4.0, usually 2.0-4.0 |
| $SiO_2$, CaO and $P_2O_5$ | 32.0-34.5 |
| Free Silica | 0.01-0.1 |

Example 2

A series of tests was conducted to evaluate the effect of blending a selected zircon aggregate with silica sand in various proportions. The selected zircon aggregate was C80 zircon from example 1. Tests were conducted to evaluate the high temperature physical properties of the blends. Test step-cone castings were poured to analyze for defects. These castings were measured to evaluate dimensional accuracy and the results were plotted out. Veining and penetration defects were analyzed and ranked according to a method developed at the University of Northern Iowa.

Samples were made from baseline silica sand and silica sand containing C80 zircon blends. All samples were tested for thermal linear expansion and viscosity, specific heat capacity and casting quality. The various sand blend samples tested are shown in Table 3.

TABLE 3

Sand Samples Tested

| | |
|---|---|
| 1 | Baseline Silica |
| 2 | Silica with 10% Zircon |
| 3 | Silica with 20% Zircon |
| 4 | Silica with 30% Zircon |
| 5 | Silica with 40% Zircon |

Core Preparation

Expansion and Step-cone cores were prepared using the Phenolic Urethane Cold-Box binder system. The sand blend samples were split using a 16 way sand splitter to obtain a representative grain distribution. Split silica sand was placed in a Kitchen Aid mixer. The C80 zircon aggregate was then added to the mixer and the blend mixed for 30 seconds. The Part I resin was then added and mixed for a minute. The mixing bowl was then removed and the sand was flipped to ensure even coating. The Part II resin was then added and the same procedure was repeated. The final mixture was then placed in the respective core boxes and was gassed in a Redford Cold-Box gassing chamber. A gassing pressure and purging pressure of 20 psi (137.8 Pa) and 40 psi (275.6 Pa) were respectively used.

Expansion cores were gassed for 0.5 minutes and purged for 7 seconds while step-cone cores were gassed for 5 seconds and purged for 30 seconds. The resulting cores were allowed to sit for 24 hours before further testing.

Tests

Thermal linear expansion tests were run using the University of Iowa's high temperature aggregate dilatometer. The dilatometer has a single push rod design and can be run under controlled atmosphere. This unit is capable of reaching a maximum temperature of 1650° C. Expansion cores made were cylindrical in shape with a height of 3.81-4.06 cm and a diameter of 2.8 cm. The samples were heated to 1650° C. at a heating rate of 15° C. per minute in a ceramic sample holder and the resulting deformation was recorded. All tests were run in a neutral atmosphere.

Surface viscosity was calculated from the deformation recorded from the dilatometer and is useful to describe the sintering characteristics of an aggregate. The method to calculate surface viscosity was first presented by Gabriel Tardos et al from the department of Chemical Engineering, City College of New York (G. Tardos, D. Mazzone, R. Pfeffer, Measurement of Surface Viscocities using a dilatometer, The Canadian Journal of Chemical Engineering, Vol. 62, P884-888). Sand grains will initially expand with temperature but will contract subsequently at high temperatures due to softening and sintering on the surface under load at inter granular contact points. The soft sand particles can be assumed to behave as a Newtonian fluid, based upon which a surface viscosity can be defined. Surface viscosity was calculated at sintering temperature for each sand sample.

Experimental Step-Cone Castings

This test was conducted by pouring metal against a step cone core. The step cone core consists of 6 different sections with steps from 1.5 inches (3.81 cm) to 4 inches (10.16 cm) in 0.5 inch (1.27 cm) increments. The different steps are representative of different section thicknesses of the metal casting and hence give a good understanding of the role of different cooling rates of the metal in casting quality and defects. The mold is produced flaskless using a similar binder system, but does not affect the veining, penetration or dimensional accuracy tendencies of the test casting. The test castings were poured from a variety of metals including grey iron, steel and copper based alloys. Pouring times for the molds are approximately 10-12 seconds. Once the castings had cooled to room temperature, they were removed and the gates sectioned off along with loose sand. The castings were wire brushed and sand blasted to remove any loose sand on the surface and were then tested for dimensional accuracy. Following this, they were sectioned and evaluated for veining and penetration defects.

Melting Procedure

The composition of the metal used in the trials was consistent with the chemistry used to produce standard class low alloy steel. The metal was melted in a 340 lb. high frequency coreless induction furnace utilizing a neutral refractory lining. After meltdown, the slag was removed, a thermal analysis sample was taken, and the temperature of the molten metal was raised to approximately 1676° C. The heats were tapped into a preheated 350 lb. heated monolithic ladle. The metal was then poured into the molds located on the pouring line using a target pouring temperature of 1600° C. An approximate total target pour time of 10 to 12 seconds was used.

Results

Figure 2:
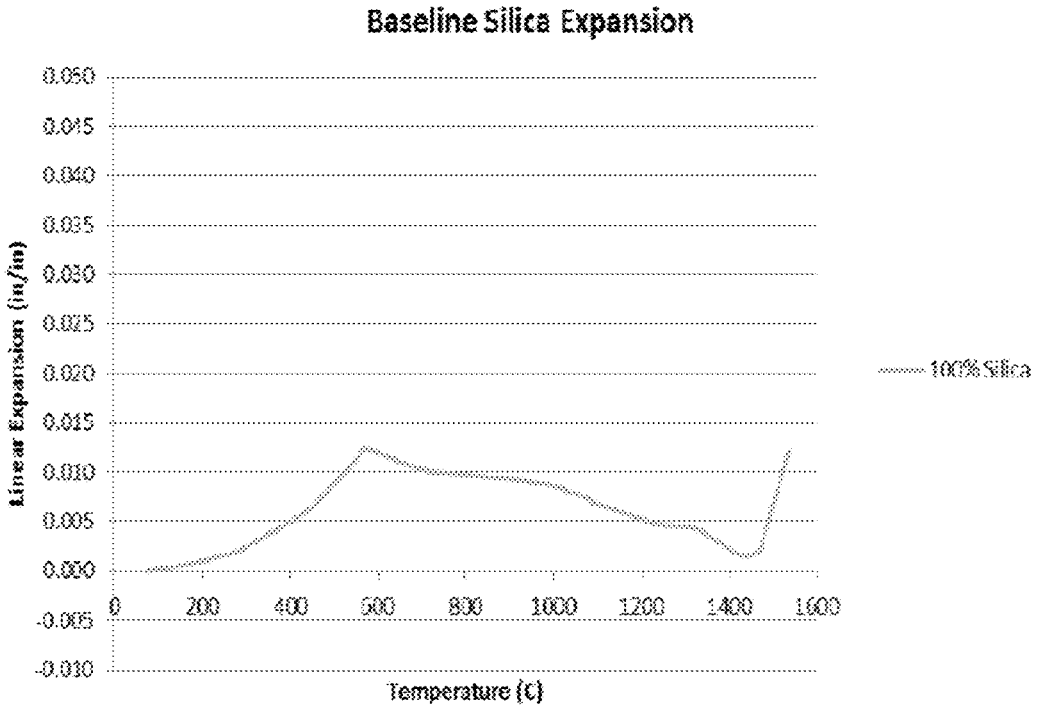
FIG. 2 is a graph of a baseline silica thermal expansion curve.

The expansion results determined for baseline silica are shown in FIG. 2. It can be seen that silica sand undergoes an alpha-beta phase transition at approximately 570° C. (1058 F). This leads to a large peak expansion at the same temperature. A peak expansion of 0.0115 in/in (cm/cm) was recorded. After the alpha-beta phase transition, a steady contraction of the sand can be seen till the cristobalite phase transition at 1470° C. where the beginning of a secondary expansion can be seen. This steady contraction exerts a strain on the surface of the core as the surface layers of a core contract while the sub layers are still expanding to the alpha-beta transition. This leads to the formation of cracks, thus leading to veining defects. The high peak expansion seen at the alpha-beta transition leads to dimensional inaccuracy of castings.

Figure 3:
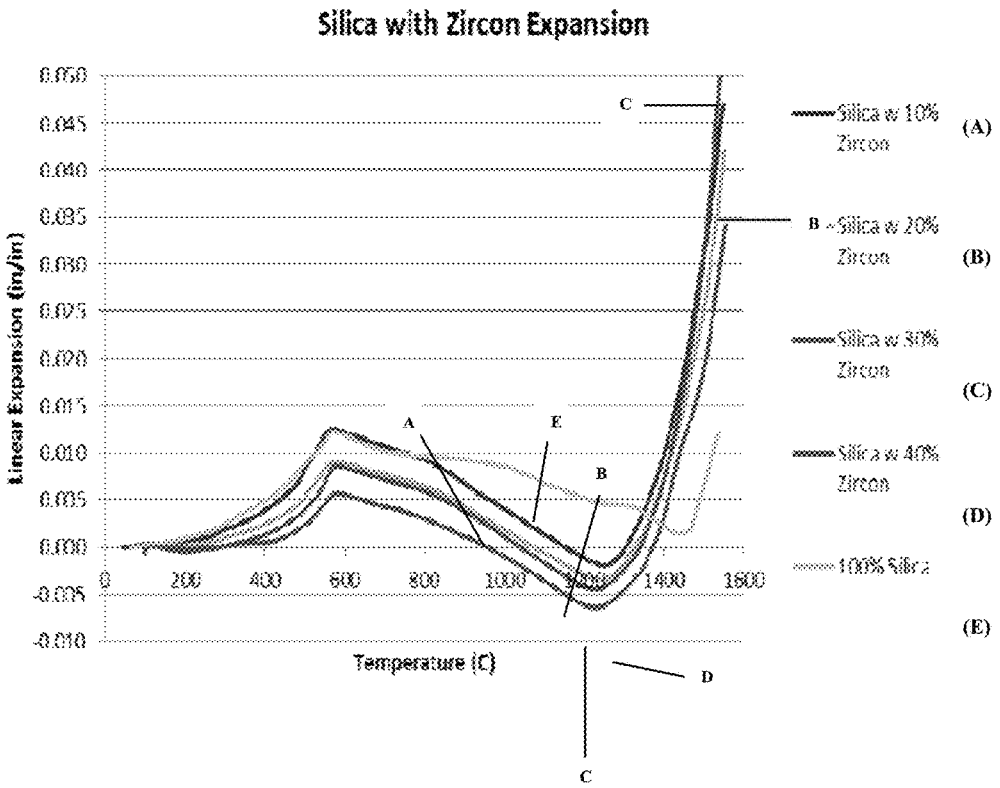
FIG. 3 is a graph showing silica with zircon blends thermal expansion curves.

FIG. 3 shows the expansion results for the silica with zircon blend samples. The peak expansion for silica with 10% zircon is similar to baseline silica sand. However, from 20% zircon onwards, a reduction in the alpha-beta phase transition peak expansion can be seen with silica with 40% zircon having the lowest peak of 0.005 in/in (cm/cm), which is lower than baseline silica by 56%.

Another trend that can be seen in the silica with zircon samples is that the cristobalite phase transition is induced at a lower temperature. A steep contraction can be seen from the alpha-beta phase transition to the cristobalite phase transition. However, since the cristobalite phase transition is occurring at approximately 1200° C. (2192 F), the large secondary expansion occurs at a lower temperature, thereby negating the strain on the surface of the core at the high temperatures seen in steel castings.

This provides a secondary increase in strength on the surface of the core, preventing cracks from forming on the surface and, hence, reducing veining defects.

The sintering temperature and the peak viscosity at sintering temperature for each sample are shown in Table 4, along with the associated specific heat capacity at 1200° C. Baseline silica has a sinter temperature of 1437.4° C. (2619.3 F) with a peak viscosity of $5.030\times10^8$ Pa·s ($5.03\times10^{11}$ cP). It can be seen that the sinter temperature of the zircon blends decreases with increasing amounts of the zircon aggregate. However, with the zircon blends, the peak viscosity increases with increasing amounts. This indicates that the core integrity at high temperatures will be higher for increasing amounts of zircon thereby leading to lower dimensional inaccuracy.

TABLE 4

Sinter Temperature and Peak Viscosity Data

| Sample ID | Sinter Temperature (C.) | Peak Viscosity (Pa · s) | Specific Heat Capacity at 1200 C. (J/g · C) |
|---|---|---|---|
| Baseline Silica | 1437.4 | $5.030 \times 10^8$ | 1.2 |
| Silica w 10% Zircon | 1252.7 | $9.282 \times 10^8$ | 1.1 |
| Silica w 20% Zircon | 1238.6 | $8.819 \times 10^8$ | 1.09 |
| Silica w 30% Zircon | 1234.3 | $1.122 \times 10^9$ | 1.07 |
| Silica w 40% Zircon | 1231.1 | $1.724 \times 10^9$ | 1.07 |

Casting Quality Analysis

Figure 4:
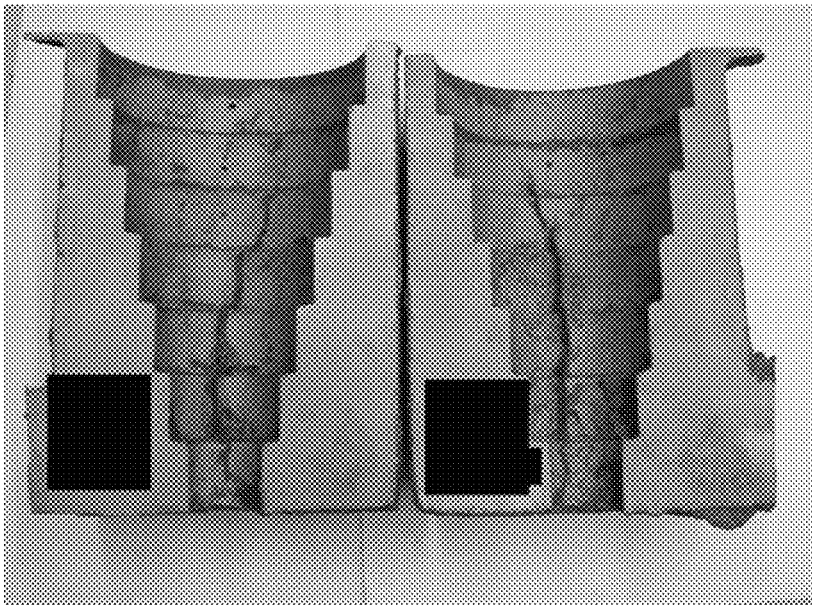
FIG. 4 is an image of baseline silica step-cone casting.

The baseline silica casting obtained is shown in FIG. 4. It can be seen that the casting exhibits several veins along the surface, which is typical of silica sand castings. No penetration defects are visible. More veins are formed along the thicker sections of the casting, where the metal takes longer to solidify. This would enable the cores to reach higher temperatures while the metal is still in its liquid form.

Figure 5:
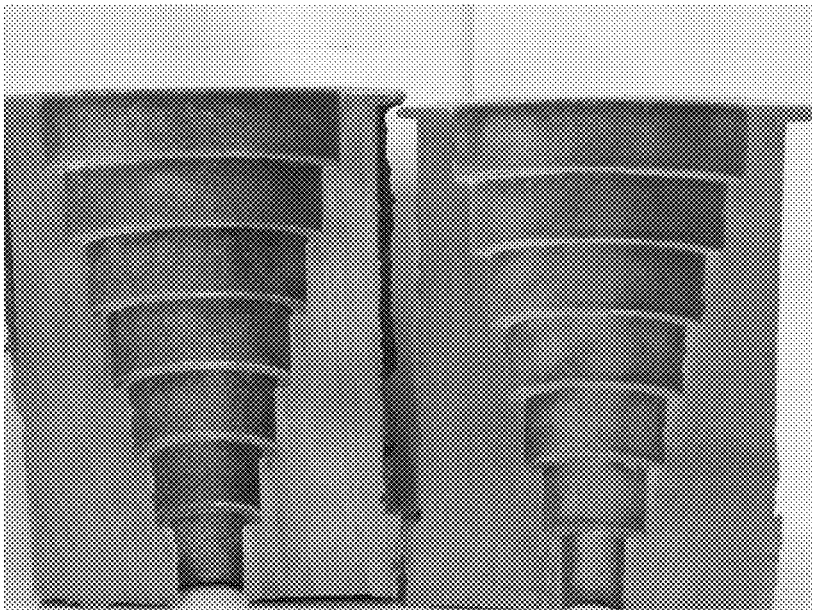
FIG. 5 is an image of silica with 10% C80 zircon.

Silica with 10% zircon (FIG. 5) does not display any veining or penetration defects. Though the alpha-beta transition peak expansion for silica with 10% zircon is similar to baseline silica, the early inducement of the cristobalite transition, the secondary expansion and higher viscosity at sintering temperature leads to lower strain on the surface of the core, thereby reducing the veining defect.

Figure 6:
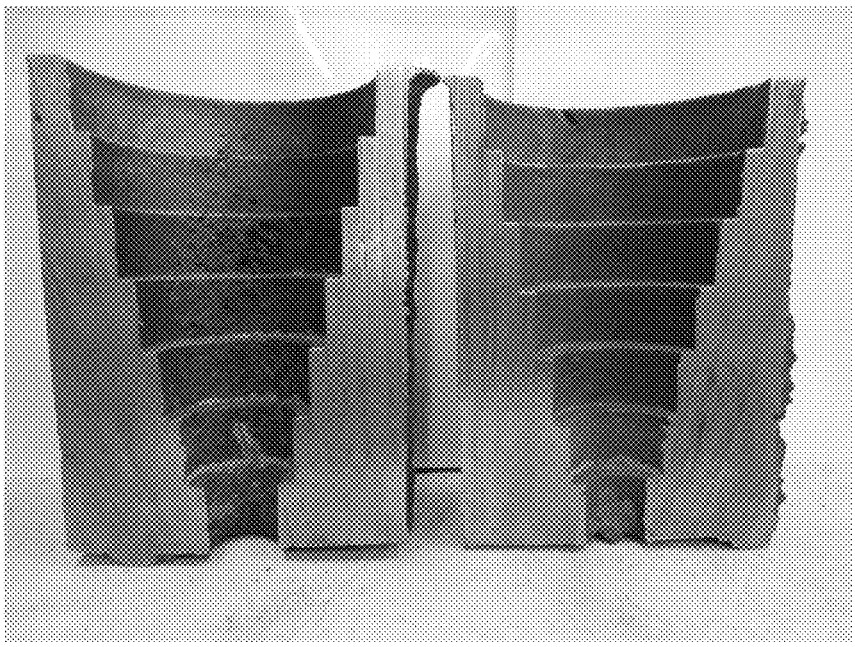
FIG. 6 is an image of silica with 20% C80 zircon.
Figure 7:
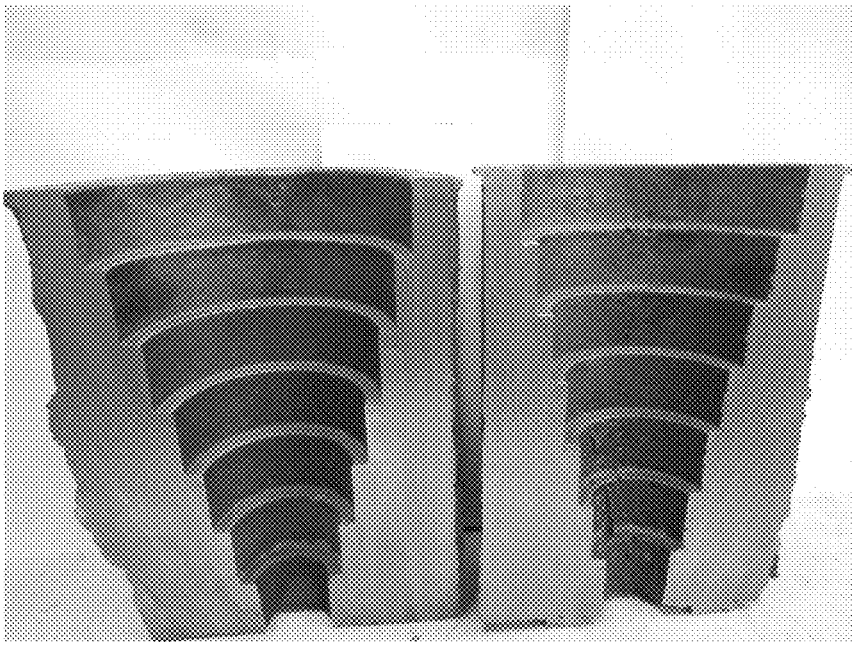
FIG. 7 is an image of silica with 30% C80 zircon.
Figure 8:
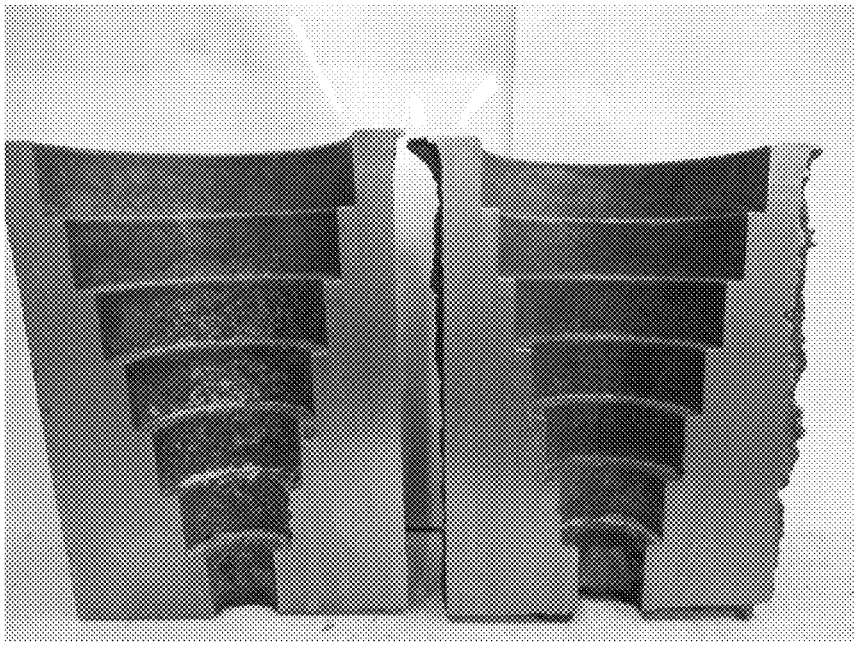
FIG. 8 is an image of silica with 40% C80 zircon.

However, silica with 20%, 30% and 40% zircon display slight veining and penetration defects at the thicker casting sections as seen in FIGS. 6, 7 and 8.

Table 5 displays the veining and penetration ranking for baseline silica and the various blends. It can be seen that a lower content of the specialty aggregates display better performance when compared to the higher content. Baseline silica has a high veining index, as expected. Silica with 10% zircon displays no indications of veining or penetration defects.

TABLE 5

Penetration and Veining Ranking

| Sample ID | Penetration Index | Veining Index |
|---|---|---|
| Baseline Silica | 0 | 43 |
| Silica w 10% Zircon | 0 | 0 |
| Silica w 20% Zircon | 11 | 9 |
| Silica w 30% Zircon | 6 | 9 |
| Silica w 40% Zircon | 11 | 5 |

It has been shown that as little as 10% of the selected zircon aggregate can improve the quality of the final casting by reducing the extent of veining and penetration defects and creating a more linear dimensional relationship between the mold cavity and the final casting dimensions. It should be noted in general that the effect of blending silica sand and specialty sands is highly dependent on the thermal input of the metal and the mass of the mold that determines the heating rate of the mold and associated cooling rate of the casting. The chemical reaction between the base sand and the specialty sand must be accurately determined, as was the case with silica sand blends. Higher heat inputs in the larger metal sections caused the mixture to fuse causing casting defects.

We claim:

1. A foundry sand comprising a blend that includes a silica sand and a zircon aggregate, the zircon aggregate exhibiting a sharp rise in linear thermal expansion coefficient in a temperature band above 1200° C.

2. A foundry sand according to claim 1 wherein the aforesaid temperature band includes commencement of the sharp rise in the linear thermal expansion coefficient of the zircon aggregate at a temperature between 1300° C. and 1500° C.

3. A foundry sand according to claim 1 wherein the aforesaid temperature band includes commencement of the sharp rise in the linear thermal expansion coefficient of the zircon aggregate at a temperature between 1325° C. and 1450° C.

4. A foundry sand according to claim 1 wherein the zircon aggregate exhibits an increase in linear thermal expansion coefficient from substantially zero to at least about 0.010 in/in.

5. A foundry sand according to claim 1 wherein the zircon aggregate exhibits an increase in linear thermal expansion coefficient from substantially zero to between 0.020 and 0.030 in/in.

6. A foundry sand according to claim 1 wherein the zircon aggregate is such that the foundry sand blend exhibits a reduced magnitude of the linear thermal expansion coefficient at an alpha-beta silica phase transition, compared to silica foundry sand.

7. A foundry sand according to claim 6 wherein the zircon aggregate is such that the foundry sand blend exhibits commencement of a cristobalite silica phase transition at a lower temperature, compared to silica foundry sand.

8. A foundry sand according to claim 7 wherein the temperature at which the cristobalite silica phase transition commences is reduced from about 1470° C. to below 1300° C.

9. A foundry sand according to claim 6 wherein the reduction in the magnitude of the linear thermal expansion coefficient at the alpha-beta silica phase transition is at least 30%.

10. A foundry sand according to claim 1 wherein the zircon aggregate is such that the foundry sand blend exhibits commencement of a cristobalite silica phase transition at a lower temperature, compared to silica foundry sand.

11. A foundry sand according to claim 10 wherein the temperature at which the cristobalite silica phase transition commences is reduced from about 1470° C. to below 1300° C.

12. A foundry sand according to claim 1 wherein the proportion of the zircon sand in the blend is in the range 5 to 40%.

13. A foundry sand according to claim 1 wherein the proportion of the zircon sand in the blend is in the range 5 to 25%.

14. A foundry sand according to claim 1 wherein the proportion of the zircon sand in the blend is in the range 5 to 15%.

15. A method of casting an article in molten metal at a temperature above 1200° C., comprising:

forming a single or multi-part mould for the article from a foundry sand comprising a blend that includes a silica sand and a zircon aggregate, the zircon aggregate exhibiting a sharp rise in linear thermal expansion coefficient in a temperature band above 1200° C.;

admitting molten metal to the mould at a temperature such that at least one or more regions of the foundry sand in contact with the admitted metal are heated to a temperature within said temperature band; and cooling the mould and metal to obtain a cast article.

16. A method according to claim 15 wherein the zircon aggregate exhibits an increase in linear thermal expansion coefficient from substantially zero to at least about 0.010 in/in.

17. A method according to claim 15 wherein the zircon aggregate is such that the foundry sand blend exhibits a reduced magnitude of the linear thermal expansion coefficient at an alpha-beta silica phase transition, compared to silica foundry sand.

18. A method according to claim 15 wherein the zircon aggregate is such that the foundry sand blend exhibits commencement of a cristobalite silica phase transition at a lower temperature, compared to silica foundry sand.

19. A method according to claim 15 wherein the proportion of the zircon sand in the blend is in the range 5 to 40%.

20. A method of casting an article in molten metal at a temperature above 1200° C., comprising:

sourcing and/or supplying a zircon aggregate that exhibits a sharp rise in linear thermal expansion coefficient in a temperature band above 1200° C.;

forming a single or multi-part mould for the article from a foundry sand comprising a blend that includes a silica sand and said zircon aggregate;

admitting molten metal to the mould at a temperature such that at least one or more regions of the foundry sand in contact with the admitted metal are heated to a temperature within said temperature band; and cooling the mould and metal to obtain a cast article.

21. A method according to claim 17 wherein the sourced and/or supplied zircon aggregate exhibits an increase in linear thermal expansion coefficient from substantially zero to at least about 0.010 in/in.

22. A method according to claim 17 wherein the sourced and/or supplied zircon aggregate is such that the foundry sand blend exhibits a reduced magnitude of the linear thermal expansion coefficient at an alpha-beta silica phase transition, compared to silica foundry sand.

23. A method according to claim 17 wherein the sourced and/or supplied zircon aggregate is such that the foundry sand blend exhibits commencement of a cristobalite silica phase transition at a lower temperature, compared to silica foundry sand.

* * * * *